United States Patent [19]

Cox

[11] Patent Number: 4,940,118

[45] Date of Patent: Jul. 10, 1990

[54] SLIP ASSEMBLY

[75] Inventor: Don C. Cox, Roanoke, Tex.

[73] Assignee: Otis Engineering Corporation, Dallas, Tex.

[21] Appl. No.: 264,891

[22] Filed: Oct. 31, 1988

[51] Int. Cl.[5] ..... B23Q 5/033

[52] U.S. Cl. ..... 188/67; 294/102.2

[58] Field of Search ..... 188/67; 81/57.18; 279/4, 71, 114; 294/102.2; 74/531

[56] References Cited

U.S. PATENT DOCUMENTS

| | | | |
|---|---|---|---|
| 1,704,057 | 3/1929 | Neilsen | 188/67 |
| 2,068,217 | 1/1937 | Abegg | 188/67 |
| 2,887,754 | 5/1959 | Johnson | 188/67 |
| 4,576,254 | 3/1986 | Cox | 81/57.18 X |

*Primary Examiner*—George E. A. Halvosa
*Attorney, Agent, or Firm*—Roland O. Cox

[57] ABSTRACT

An hydraulically operated slip assembly useful to grip pipe being run into or pulled from a well. This assembly has upper and lower plates, each having a passage for pipe. Wedges, carrying unique slip systems are positioned around the passages between the plates and are slidably mounted for guided radial movement inwardly to grip pipe and outwardly to ungrip pipe as moved by an hydraulic cylinder pivotally mounted aside on the lower plate. The unique slip systems automatically increase grip on pipe on up or down movement of gripped pipe caused by up or down loads on the pipe. Forces resulting from increased pipe grip develop frictional forces within the slip assembly, which effectively prevent outward movement of the wedges after inadvertent or on purpose operation of the cylinder to ungrip the pipe. The pipe must be returned to near the neutral position where the slip systems are not automatically gripping pipe tighter before the cylinder can move the slip systems outwardly to ungrip pipe.

21 Claims, 4 Drawing Sheets

SLIP ASSEMBLY

BACKGROUND OF THE INVENTION

Technical Field:

This invention relates to an hydraulically operated double acting slip assembly useful to grip pipe as required while pipe is being run into or pulled from a well.

2. Related Art:

This invention is an improvment of my slip assembly of U.S. Pat. No. 4,576,254, which is herein incorporated for reference.

My previously patented slip assembly structure included double acting slip systems, which for being operated to grip pipe, automatically gripped the pipe tigher on slight upward or downward movement of the pipe caused by a small upward or downward load on the pipe. These small loads may occur each time the slips are operated to grip pipe as pipe is being run into or pulled from a well through the slip assembly. Slight movement of the pipe automatically causes the slip systems to grip pipe tighter and forces resulting from the tighter grip induce frictional forces between slip assembly members, which are greater than forces applied to the slip assembly members by a pressurized hydraulic operating cylinder to move the slip systems to a position not gripping pipe; therefore, the slip systems cannot be moved inadvertently or on purpose to a position not gripping pipe unless the pipe is repositioned slightly upwardly or downwardly to the precise "neutral" position where the automatic grip tightening system is not operating.

Field operation of the slip assembly of the previously mentioned U.S. patent showed a need to increase the height of the neutral position "band" as operators had to vertically reposition pipe small distances many times, when the slip systems were automatically gripping pipe tighter, before the pipe was at the precise level where the pressurized operating cylinder could move the slip systems to a position not gripping pipe. It is very difficult and time-consuming to move heavy pipe loads repeatedly up or down small distances trying to locate a very narrow neutral position band. Also, manufacturing problems and expense experienced with the structure used to position and guide the wedges and slip systems required new structure.

SUMMARY OF THE INVENTION

The hydraulically actuated slip assembly of this invention includes wedges each carrying a double acting slip system which are moved radially inwardly and outwardly to grip or ungrip pipe by rotating camming segments pivotally connected in the inner race of a ring bearing, which is supported in ring segments spaced around the bearing. The camming segments are grooved top and bottom and are slidably connected to the outside of the slip wedges by engaging segment grooves in a "T" slot in the outside of each wedge. The bearing supporting ring segments are mounted between upper and lower plates, each of which has an opening, for pipe passage. The bottom plate has an appropriate connection for connecting the slop assembly to a well servicing unit or wellhead. An hydraulic operating cylinder is pivotally connected to the lower plate and the cylinder piston rod is pivotally connected to the camming segments and inner bearing race.

To move the wedges and slip systems inwardly to grip pipe, pressure is introduced into the cylinder to extend the piston rod and rotate the bearing inner race and camming segments, sliding the thicker portions of the camming segments between the wedges and ring segments, moving the wedges and slip systems inwardly.

Each wedge carries a double acting slip system with an insert having teeth on its inner surface, which grips the outside of the pipe on inward movement of the wedges.

Each slip system is spring loaded to a neutral position. Any up or down load on gripped pipe which causes up or down movement of the pipe and slip systems from neutral position will automatically move the slips inwardly along their wedges, resulting in more tightly gripped pipe. The slip systems have secondary wedge slidable mounted on each wedge for downward and and inward movement and slips slidably mounted on each secondary wedge for upward and inward movement. The wedges and slips have pawls which extend into grooves in cam plates attached to the secondary wedges, slidably connecting the wedges, secondary wedges and slips together.

The invention slip assembly includes an excellent safety feature which prevents operating the slip assembly, either inadvertently or on purpose, to ungrip pipe when the gripping slips are automatically gripping the pipe tighter. The outward force components resulting form inward movement of the slips up or down along their wedges to automatically grip pipe tighter are transmitted through the wedges and press camming segment surfaces against ring segment surfaces. The frictional forces between the contacting camming segment and ring segment surfaces are greater than the rotating forces imparted to the camming segments by the pressurized hydraulic cylinder and the camming segments cannot be rotated to move the wedges and slip systems outwardly ungripping the pipe.

Before the slip assembly can be operated to ungrip pipe, the pipe must be vertically repositioned to within the slip systems neutral band where frictional forces preventing return of the slip systems to outward position ungripping pipe are not developed. To prevent repeated vertical repositioning of pipe, while hunting a narrow neutral band, the slip assembly of this invention has been provided with additional vertical slip system movement from neutral position of about 0.7 inches upward or downward before the slip systems are automatically moved inwardly to grip pipe tighter and cannot be operated to ungrip.

The slip assembly of this invention also includes improved structure which guides the slip system wedges when moved radially inward and outward and positions the wedges between the upper and lower plates equally spaced around the openings for pipe passage in the plates.

An object of this invention is to provide a slip assembly which automatically grips gripped pipe tighter on upward or downward movment of gripped pipe of more than about 0.7 inches.

Another object of this invention is to provide a slip assembly which cannot be operated to ungrip pipe when gripping pipe tighter.

Also an object of this invention is to provide a slip assembly which does not require repeated repositioning of tighter gripped pipe to permit operation to ungrip pipe.

Another object of this invention is to provide a slip assembly having improved radial guides for the slip systems.

An object of this invention is to provide an improved slip assembly having slip system elements slidably connected together for inward movment by cam plates

DRAWING DESCRIPTION

DESCRIPTION OF THE PREFERRED EMBODIMENT

Figure 1:
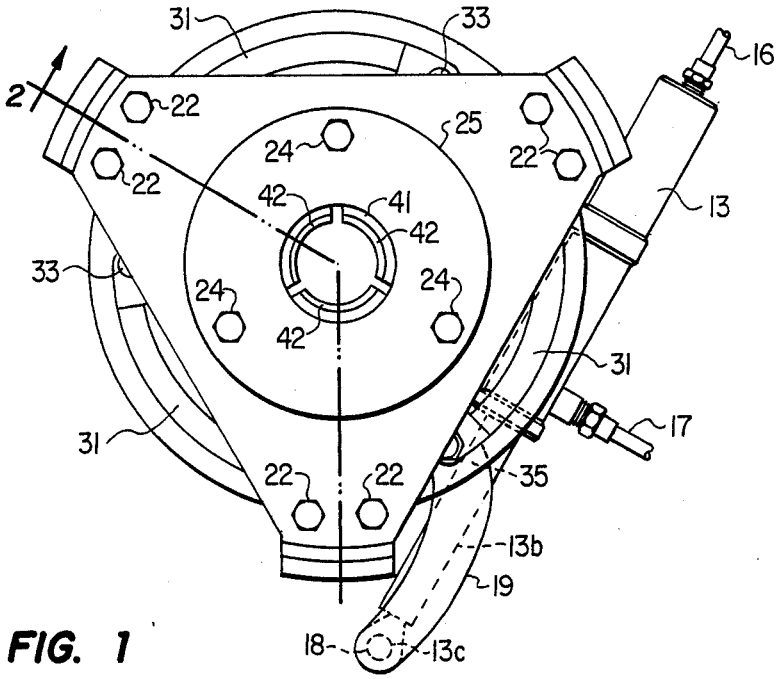
FIG. 1 is a top view drawing of the slip assembly of this invention.
Figure 2:
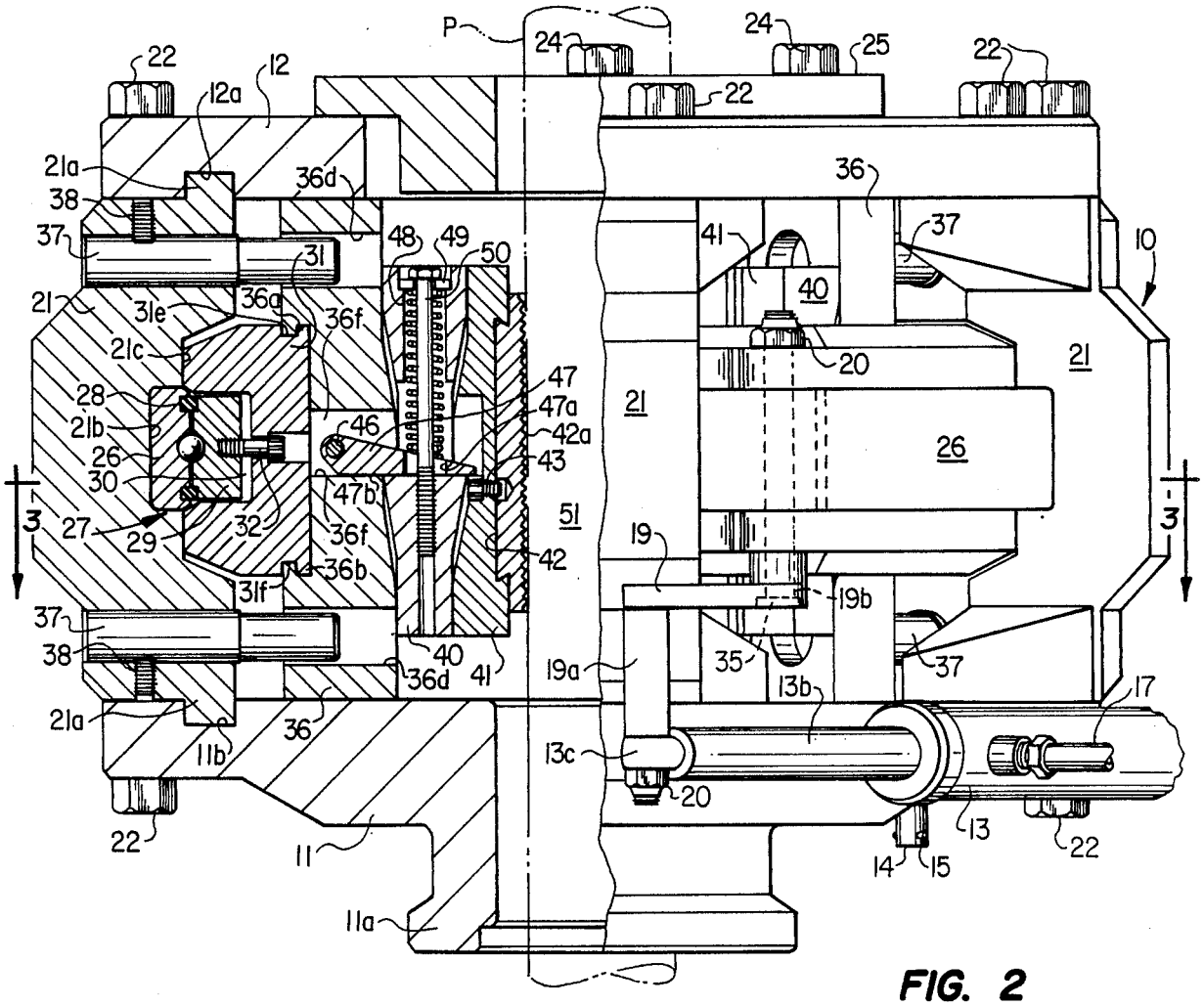
FIG. 2 is a half section drawing in elevation showing the slip assembly operated to grip pipe.

FIGS. 1 and 2 show the improved slip assembly 10 of this invention having a lower plate 11 and an upper plate 12. The lower plate has a connection **11*a* for connecting the lower plate and slip assembly to a well head or well servicing unit. Pivotally mounted in slot 11*b* in the lower plate is an hydraulic operating cylinder 13. This operator is attached in the bottom plate slot by a pin 14 through hole 11*c* in the lower plate and cylinder tab 13*a*. The pin is retained in the hole by drive pins 15. Connected to the cylinder are conduits 16 and 17, useful in conducting pressured fluids into and from the cylinder for operation of the slip assembly. The cylinder has a rod 13*b* having a hole 13*c* in which is mounted a bearing 18. An operating arm 19 has rod portion 19*a* which is inserted through a hole in the bearing, pivotally connecting the operating arm and operator. The connection is secured with pinned castle nut 20**.

Mounted between the upper and lower plates are three identical ring segments 21, spaced 120 degrees apart and positioned by upper and lower ring segment extensions **21*a* protruding into mating grooves 11*b* and 12*a* in the lower and upper plates, with pairs of top and bottom bolts 22 passing through holes in the upper and lower plates and screwed into threaded holes in each ring segment, fastening each ring segment to the upper and lower plates. Between the upper and lower plates are rods 23 having pin portions fastened in flat bottom holes in the lower plate with bolts 24 securing a cover 25** and the upper plate to these rods.

Each ring segment 21 has a large radial groove **21*b* and a small wider groove 21*c* cut inside. Housed in the larger inside segment grooves is an outer bearing race 26 of sealed ring bearing 27, having seals 28 and an inner race 29. The inner race has holes 29*a* spaced 120 degrees apart and is housed in grooves 30 in the outside surfaces of three camming segments 31. Screws 32 connect each camming segment to the bearing inner race and each segment is provided with a slot 31*a* and a cross hole 31*b*. Each camming segment has an outer arcuate surface 31*c* and a concentric inner arcuate surface 31*d* in groove 30. Two of the camming segments are pivotally connected to the bearing inner race by pins 33 surrounded by bushing 34 in holes 31*b* in the camming segments and two holes 29*a* spaced 120 degrees apart in the bearing race. A longer pin 35 is pased through holes 19*b* in the operating arm, hole 31*b* in the third camming segment and third hole 29*a* in the inner bearing race, connecting the arm, camming segment and inner race. Pin 35 is secured with another nut 20**.

Each camming segment has an upper radial groove **31*e* and a lower radial groove 31*f* spaced from and concentric with inner arcuate surface 31*d***.

Figure 5:
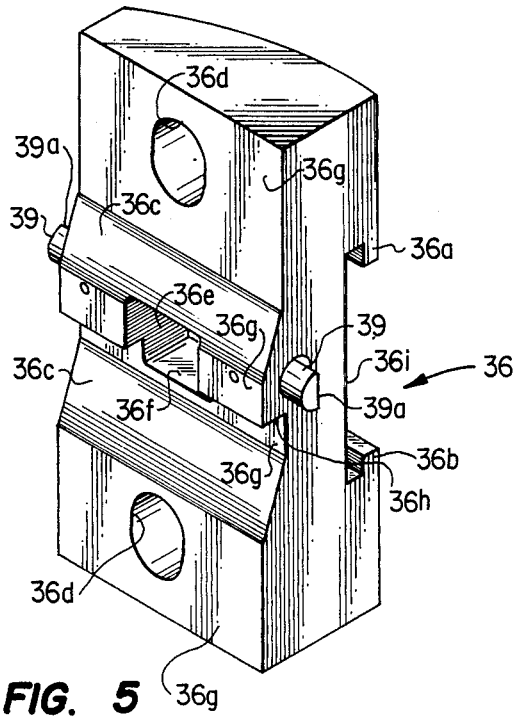
FIG. 5 is a isometric drawing of the wedge with pawls utilized in this invention.
Figure 4:
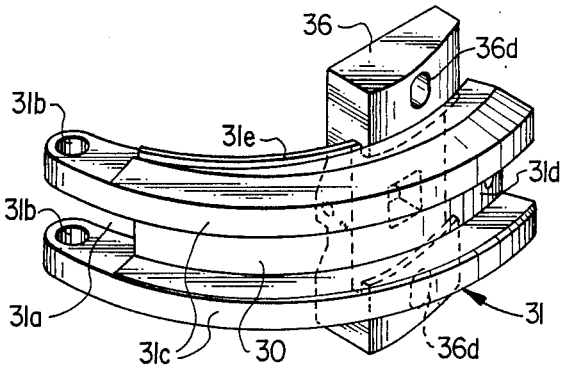
FIG. 4 is a isometric drawing showing the slidable connection of wedges and camming segments.

Cut across the outer surface of each wedge 36 as shown in FIG. 5, is a "T" slot **36*i*. Each wedge also has inward extensions 36*a* and 36*b*, which are slidably engageable in camming segment grooves 31*e* and 31*f*, slidably connecting each camming segment to each wedge as shown in FIG. 4. Each wedge is provided with upper and lower downwardly and inwardly inclined surfaces 36*c*, a pair of holes 36*d*, a through opening 36*e* having a lower flat surface 36*f*, vertical surface 36*g* and a shoulder 36*h***.

There are pairs of rods 37 anchored in each ring segment 21 with set screws 38. Each wedge is slidably mounted on a pair of rods in holes **36*d*** between the upper and lower plates for radial inward and outward movment.

Figure 7:
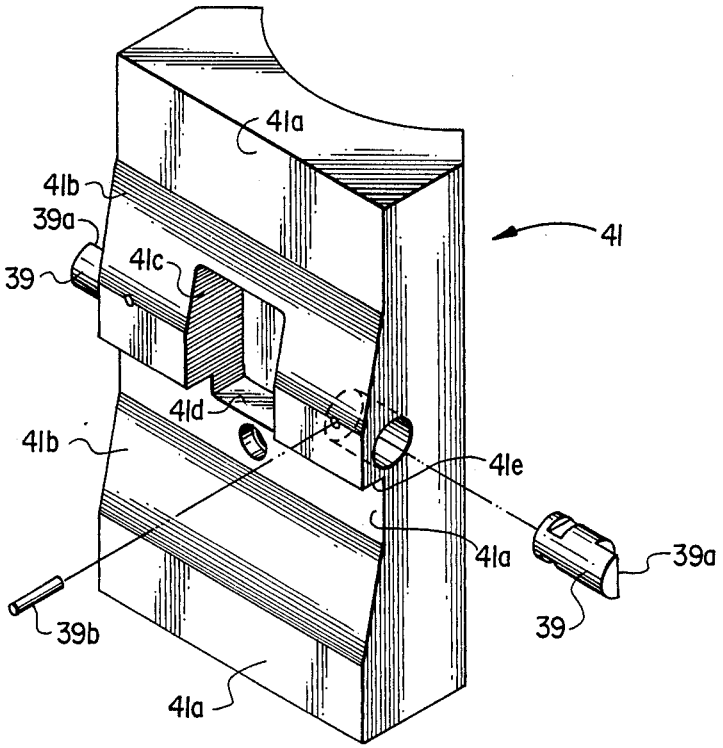
FIG. 7 is an isometric drawing showing the slip with pawls and insert and detail of a typical pawl connection to the wedges and slips.

Swivelably mounted in each side of each wedge is a pawl 39. FIG. 7 shows how each pawl is typically connected to the wedges and slips so that pawl flat surface **39*a*** may be rotated plus or minus 10 degrees for vertical.

Figure 6:
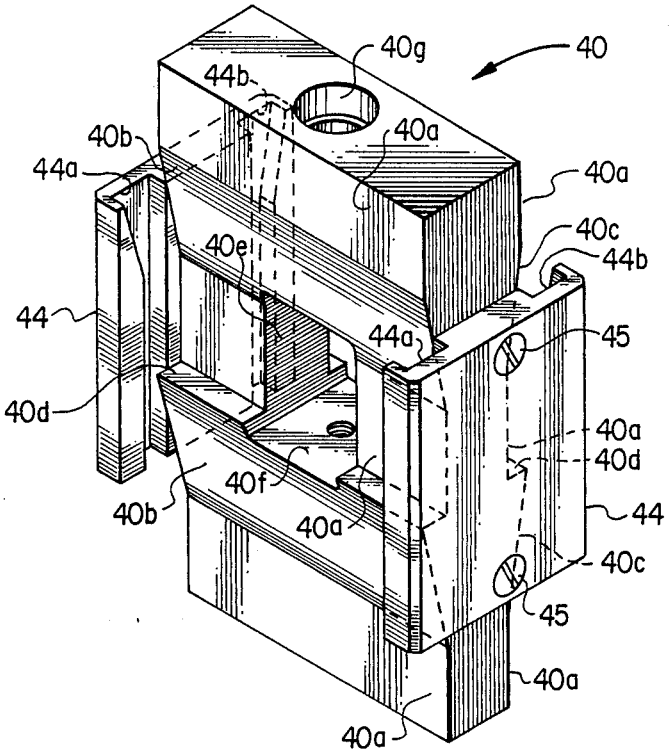
FIG. 6 is an isometric drawing showing the secondary wedge of this invention with cam plates attached.

A secondary wedge 40, shown in FIG. 6, is slidably mounted on each wedge for downward movment only. This wedge has outer and inner vertical surfaces **40*a*, upper and lower downwardly and inwardly inclined surfaces 40*b*, upper and lower downwardly and outwardly inclined surfaces 40*c*, outer and inner shoulders 40*d*, an opening 40*e* having a lower flat surface 40*f* and a hole 40*g***.

A slip 41 (FIG. 7) having an insert 42 is slidably mounted on each secondary wedge for upward movement only. The insert has teeth **42*a* on its inner surface for gripping pipe. An insert is positioned and retained in each slip by a screw 43. The slip also has vertical surfaces 41*a*, upper and lower downwardly and outwardly inclined surfaces 41*b*, a recess 41*c* having a lower flat surface 41*d* and a shoulder 41*e*. Pawls 39, each having flat surface 39*a*** are swivelably mounted on each side of the slips so that the flat surface may be rotated pluse or minus 10 degrees from vertical.

Each slip is slidably connected to a secondary wedge and each secondary wedge slidably connected to a wedge by cam plates 44 attached to each secondary wedge with screws 45 as shown in FIG. 6.

Each cam plate has outer and inner rectangular grooves **44*a* and 44*b***, with 40 percent of the outer side of the outer groove inclined upwardly and outwardly on an 8½ degree angle and 40 percent of the inner side of the inner groove inclined upwardly and inwardly on an 8½ degree angle. All inclined surfaces on the wedges, secondary wedges and slips of the invention slip assembly are inclined preferably 8½ degrees from vertical. Inclination angles within a range of 5 to 10 degrees would be satisfactory.

Figure 8:
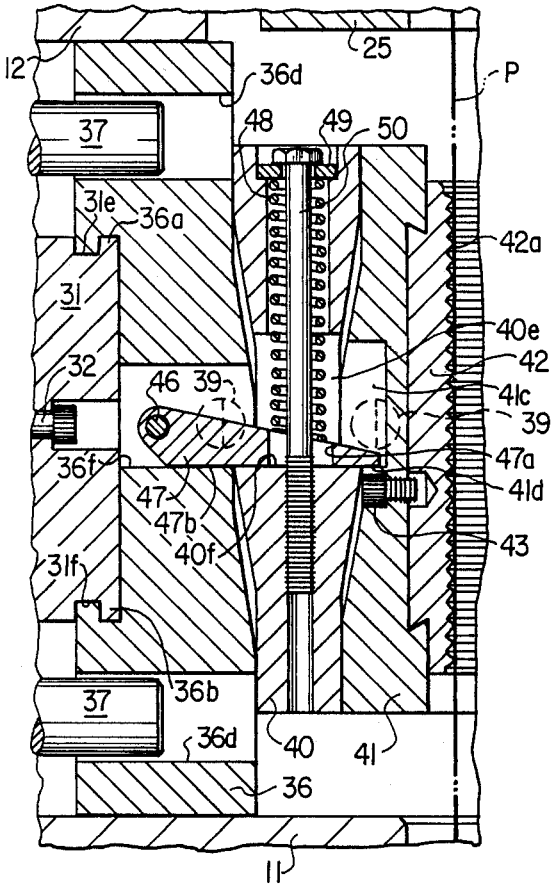
FIG. 8 is a fragmentary section showing a slip system in neutral position gripping pipe.

Pivotally connected in each wedge opening 36*e* by a pin 46 is an arm 47, which extends through secondary wedge opening 40*e* and into slip recess 41*c*. A spring 48 in secondary wedge hole 40*g* is compressed between the top of the arm and a washer 49 under the head on bolt 50 because the spring cannot go through a slot 47*a* in the arm. The compressed spring applied an upward force on the bolt, lifting secondary wedge 40 to engage outer secondary wedge shoulder 40*d* with wedge shoulder 36*h* and causing wedge flat surface 40*f* to contact the lower flat surface 47*b* on arm 47. The compressed spring also applies a down force to the arm engaging inner secondary wedge shoulder 40*d* with slip shoulder 41*e* and causing arm flat surface 47*b* to contact wedge flat 36*f* and slip recess flat surface 41*d* to align surfaces 36*f*, 40*f* and 41*d* and position slips 41 in mid neutral position not gripping pipe tighter, as shown in FIG. 8.

Figure 3:
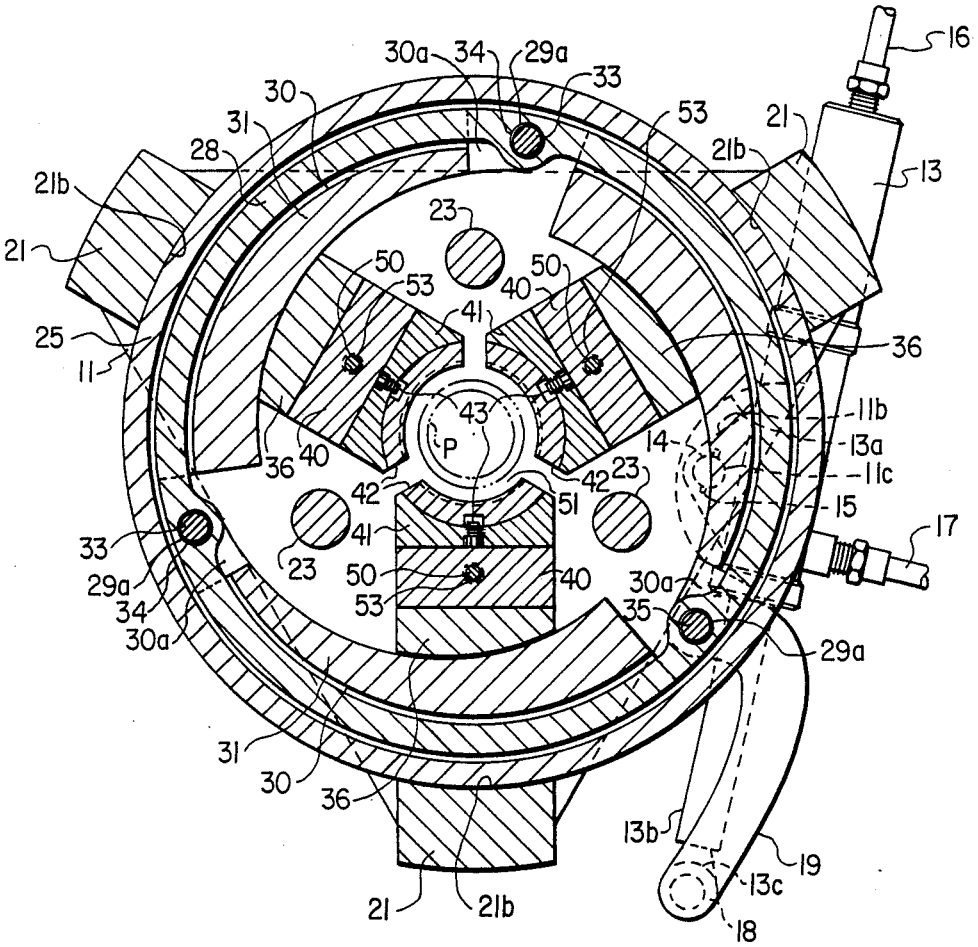
FIG. 3 is a cross sectional drawing along line 3—3 in FIG. 2, showing the slip assembly operated to ungrip pipe.

The slip assembly of this invention may be used to grip pipe run through the assembly into a well by connecting the assembly to a wellhead or into a well servicing unit with connector 11*a*. Conduits 16 and 17 are connected to a remote pressure source such that pressurized fluid may be selectively delivered to cylinder 13 through either conduit. Conduit 17 is pressurized to move wedges 36 and 40 and slips 41 radially outward to ungrip pipe as shown in FIG. 3. Well pipe P, to be gripped intermittently as it is run or pulled from a well passes through pipe passage 51.

To operate the slip assembly to grip pipe, pressurized fluid is delivered to cylinder 13 through conduit 16 causing extension of rod 13*b* from the cylinder, moving operating arm 19. As the operating arm is connected to a camming segment 31 and the inner bearing race with pin 35, movement of the arm rotates the inner bearing race and camming segments connected to the race with pins 33. The wedges 36 carrying secondary wedges 40 and slips 41 are slidably mounted between the upper and lower plates on rods 37 which prevent rotation of the wedges. When the inner bearing race and camming segments are rotated clockwise by extension of the cylinder rod, the camming segments 31 slide across the outside of the wedges and the thicker portions of the camming segments move between the wedges 36 and ring segment grooves 21*c*, pushing the wedges inwardly until teeth on slip insert 42 contact and grip pipe P as shown in FIG. 2. Inward wedge push and pipe grip is maintained by pressurized fluid in conduit 16 applying continued turning force on the inner race and camming segments from the extended cylinder rod through the arm. When fluid in conduit 17 is pressurized, rod 13*b* retracts into the cylinder rotating the camming segments to slide a thinner section between the wedges and ring segment grooves, the wedges are pulled radially outward to a position not gripping pipe through the "T" slot connections as the camming segments are connected to the bearing inner race by screws 32 (See FIG. 3).

When the slip assembly has been operated to grip pipe, the resulting outward force compresses the thicker sections of the camming segments between the wedges and ring segments so that the outer surfaces of wedges 36 push the outer surfaces 31 of the camming segments into ring segment grooves 21*c*.

Figure 9:
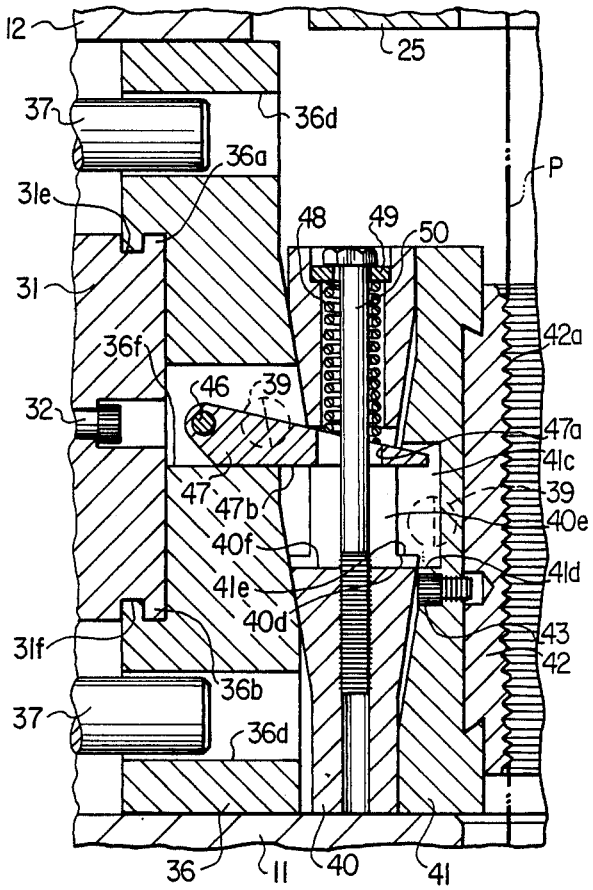
FIG. 9 is a fragmentary section drawing showing a slip system automatically gripping downwardly loaded pipe tighter.

The double acting grip tightening slip systems carried between each wedge and slip insert are actuated automatically by upward or downward movement of gripped pipe from the neutral gripped pipe position shown in FIG. 8. A small weight on gripped pipe sufficient to cause downward movement of insert 42 and slip 41 will also move the secondary wedge 40 downwardly on the wedge 36 through slip shoulder 41*e* contacting secondary wedge inner shoulder 40*d*. After the secondary wedge is moved downwardly on the wedge about 0.70 inches, the outer upper and lower downwardly and inwardly inclined secondary wedge surfaces 40*b* engage the upper and lower downwardly and inwardly inclined wedge surfaces 36*c*. Downward movment of the secondary wedge moves bolt 50 downwardly compressing spring 48 on arm 47 which cannot pivot downwardly a arm surface 47*b* is stopped by wedge surface 36*f*. Further downward movment of the slips and secondary wedges together along wedge inclined surfaces 36*c* results in inward movement of the secondary wedges, slip and their insets, causing deeper penetration of the slip teeth into the gripped pipe, increasing pipe grip as shown in FIG. 9. Pawls 39 on the wedges and slips sliding in grooves 44*a* in cam plates 44, which are attached to the secondary wedges, connect the wedges, secondary wedges and slips and provide sliding contact of the vertical and inclined surfaces.

Figure 10:
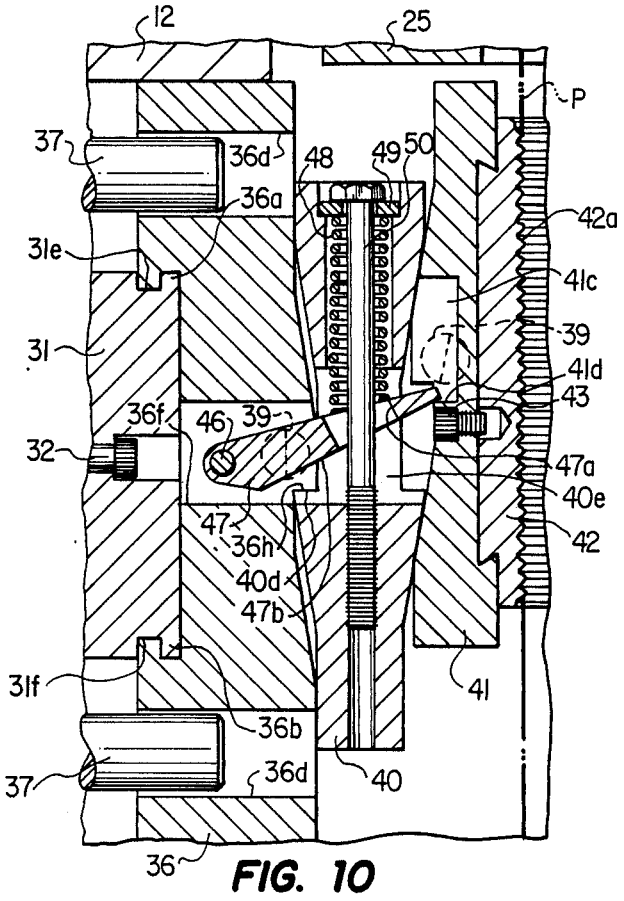
FIG. 10 is a fragmentary section drawing showing a slip system automatically gripping upwardly loaded pipe together.

Conversely, a small upward force on gripped pipe sufficient to cause upward movement of inserts 42 and slips 41 on the secondary wedge will lift arm 47 on recess flat 41*d* to pivot around pin 46 and compress spring 48. The secondary wedge cannot move upwardly on the wedge as outer secondary wedge shoulder 40*d* is contacting wedge shoulder 36*h*. After about 0.70 inches of upward slip movement on the second wedge, upper and lower inclined slip surfaces 41*b* will contact the inner secondary wedge upper and lower inclined surfaces 40*c*. Further upward movemnt of the slips will move the slips inwardly along secondary wedge surfaces 40*c*, causing teeth 42*a* to penetrate into gripped pipe and grip the pipe tighter as shown in FIG. 10. When upward or downward loads on gripped pipe are removed or the slip assembly is not gripping pipe, springs 50 push down on the arms or lift the secondary wedges and slips to be realigned on the arm lower surface, returning the slip systems to mid neutral position as shown in FIGS. 2 and 8.

When pipe loads up or down are sufficient to cause automatic operation of the grip tightening slip systems, increased outward forces resulting from increased inward forces on tighter gripped pipe are transmitted through slips, secondary wedges and camming segments, pressing the outer camming segment surfaces 31*c* into ring segment grooves 21*c*. Frictional forces generated between these contacting surfaces acting through the radial distance to the center of the pipe are great enough to prevent the pressurized cylinder from rotating the camming segments to move the wedges radially outward to ungrip the pipe. Therefore, the slip assembly of this invention cannot be operated, either inadvertently or on purpose, to ungrip pipe when the slip systems are automatically gripping pipe tighter.

To operate the slip assembly to ungrip tighter gripped pipe, the pipe must be moved upwardly or downwardly to move the slips back into the neutral band less than 0.70 inches above or below the mid neutral position of the slip systems, as shown by FIGS. 2 and 8.

When the slip systems are not gripping pipe tighter or gripping pipe, springs 48 are free to extend pushing the arms and slips downwardly or lifting the secondary wedge until flat surfaces 36*f*, 40*f* and 41*d* are contactig arm lower surface 47*b* aligning the wedges, secondary wedges and slips in mid neutral position.

What I claim is:

1. An hydraulically operated double acting slip assembly comprising:

(a) housing means including, a lower plate with a connector thereon and a passage for pipe therethrough, an upper plate, a cover secured to said upper plate with a passage for pipe therethrough, and ring segments between said plates around said pipe passages, said segments connected to said plates;

(b) a pair of guide rods anchored in each said ring segment;

(c) pipe gripping means, slidaly mounted on said rods for gripping pipe passing through said passages including double acting slip means for initially gripping pipe and increasing gripping force on gripped pipe ,said slip means automatically increasing gripping force on gripped pipe by load on gripped pipe causing more than about 0.70 inches upward or downward movement of pipe, said double acting slip means including a wedge slidably mounted on each pair of guide rods, said wedge having a "T" slot across the outer surface thereof, spaced apart upper and lower downwardly and inwardly inclined surfaces on the inner surface thereof and an opening between said "T" slot and said inner surface, said opening having a lower flat surface, a secondary wedge having spaced apart upper and lower downwardly and inwardly inclined surfaces on the outer surface thereof, upper and lower downwardly and outwardly inclined surfaces on the inner surface thereof and an opening between said inner and outer surfaces, said opening having a lower flat surface, slip means including a slip having spaced apart upper and lower downwardly and outwardly inclined surfaces and a recess on the outer face thereof, said recess having a lower flat surface, means slidably connecting said secondary wedges to said wedges and said slips to said secondary wedges so that said outer secondary wedge surfaces slide on said wedge inner surfaces and said outer slip surfaces slide on said inner secondary wedge surfaces, said slidably connecting means including pawls swivelably connected into each side of said wedges and slips, each said pawl having a flat surface, cam plates connected to each side of said secondary wedges, said cam plates having inner and outer grooves, said flat surfaces on said wedge pawls slidable in said cam plate outer grooves and said flat surfaces on said slip pawls slidable in said cam plate inner grooves, means preventing said secondary wedges from sliding upwardly on said wedges, means preventing said slips from sliding downwardly on said secondary wedges, and means for positioning each slip and secondary wedge in mid neutral position on each wedge;

(d) operating means slidably connected in said wedge "T" slots for moving said gripping means inwardly and outwardly along said guide rods to initially grip and upgrip pipe; and (e) means preventing said operating means from moving the gripping means outwardly to a position not gripping pipe when said acting slip means are automaticlly increasing gripping force on gripped pipe.

2. The slip assembly of claim 1 wherein the wedge, secondary wedge and slip inclined surfaces are inclined 8½ degrees from vertical.

3. The slip assembly of claim 1 wherein the slip means comprise a slip insert having an inner surface for gripping pipe anchored in each slip.

4. The slip assembly of claim 1 wherein the cam plate grooves are retangular in cross section and the upper portion of the outside of the outer groove is inclined upwardly and outwardly 8½ degrees from vertical and the upper portion of the inside of the inner groove is inclined upwardly and inwardly 8½ degrees from the vertical.

5. The slip assembly of claim 1 wherein the means preventing the secondary wedges from sliding upwardly on the wedges comprise:

(a) a downwardly facing shoulder on the inner surface of each wedge; and (b) an upwardly facing shoulder on the outer surface of each secondary wedge.

6. The slip assembly of claim 1 wherein the means preventing the slips from sliding downwardly on the secondary wedges comprise:

(a) a downwardly facing shoulder on the outer surface of each slip; and (b) an upwardly facing shoulder on the inner surface of each secondary wedge.

7. The slip assembly of claim 1 wherein the means for positioning each slip and secondary wedge in mid neutral position on each wedge comprises:

(a) an arm pivotally connected in each wedge opening, said arm extending through the secondary wedge opening into the slip recess and having a lower flat surface;

(b) a compressed spring mounted around a bolt anchored in a hole in said secondary wedge so that said spring applies a downward force on said arm; and (c) lower flat surfaces in said wedge opening, said secondary wedge opening and said slip recess flat surfaces engageable with said arm lower flat surface.

8. The slip assembly of claim 1 wherein the operating means comprise:

(a) an hydraulic cylinder having a rod, said cylinder mounted on the lower plate;

(b) conduits for delivering pressurized fluid to said cylinder for extending and retracting said rod from and into said cylinder;

(c) a radial bearing supported in the ring segments, said bearing having an inner race and an outer race;

(d) camming segments supported by and connected to said bearing inner race, said segments pivotally connected to each other and slidably connected in the wedge "T" slats; and (e) an arm pivotally connected to said rod and pivotally connected to said bearing inner race and one of said camming segments.

9. The slip assembly of claim 8 wherein the radial bearing is a sealed bearing.

10. The slip assembly of claim 8 further including a bearing swivelably mounted in the arm between said arm and the rod.

11. The slip assembly of claim 8 wherein the means preventing outward movement of the gripping means are outward forces on the camming segments resulting from the slips automatically grippig pipe tighter which develop frictional forces between the outer surface of the camming segments and the contacting wide groove areas in each ring segment.

12. An hydraulically operated double acting slip assembly comprising:

(a) a lower plate with a connector thereon and a passage for a pipe therethrough;

(b) an hydraulic operating cylinder pivotally connected to said lower plate, said cylinder having a rod extensible therefrom;

(c) an upper plate;

(d) a cover secured to said upper plate with a passage for pipe therethrough;

(e) ring segments, having horizontal grooves therein, disposed around said pipe passage and connected between said plates;

(f) pairs of guide rods anchored in each said ring segment;

(g) a radial bearing having an outer race and an inner race, said outer race supported in said ring segment grooves;

(h) camming segments having outer grooves wherein said bearing inner race is mounted, said camming segments connected to each other and fastened in said inner race;

(i) pipe gripping means slidably mounted on each pair of guide rods for inward and outward movement, said pipe gripping means including, a wedge slidably, mounted on each pair of guide rods, said wedge having a slot across the outer surface thereof, spaced apart upper and lower downwardly and inwardly inclined surfaces and a downwardly facing shoulder on the inner surface thereof, pawls swivelably connected into each side of said wedge, and an opening between said slot and said inner surface, said opening having a lower flat surface and said wedge having an arm pivotally mounted in said opening, said arm having a lower flat surface, a secondary wedge having spaced upper and lower downwardly and inwardly inclined surfaces and an upwardly facing shoulder on the outer surfacae thereof, upper and lower downwardly and outwardly inclined surfaces and an upwardly facing shoulder on the inner surface thereof and an opening between said inner and outer surfaces, said opening having a lower flat surface, a slip having spaced apart upper and lower downwardly and outwardly inclined surfaces, an upwardly facing shoulder, pawls swivelably connected into each side of said slip and a recess on the outer face thereof, said recess having a lower flat surface, said slip also having an insert anchored therein, said insert having an inner surface for gripping pipe, cam plates connected to each side of said secondary wedge, said cam plates having inner and outer grooves, said wedge pawls slidable in said outer grooves and said slip pawls slidable in said inner grooves, a spring anchored in said secondary wedge biasing said arm downwardly to engage to lower flat surface thereon with said wedge lower flat surface, said secondary wedge lower flat surface and said slip lower flat surface to align said wedge, said secondary wedge and said slip and;

(j) an arm pivotally connected to said cylinder rod on one end and pivotally connected to one of said camming segments and said bearing inner race on the other.

13. An improved slip system, useful in slip assemblies for gripping pipe passing through the assembly, including a double acting slip automatically moveable inwardly to grip gripped pipe tighter by more than about 0.70 inches upward or downward movement of said slip, each slip system comprising:

(a) a wedge mounted for inward and outward movement in the assembly to grip and ungrip pipe, said wedge having an outer surface, spaced apart upper and lower downwardly and inwardly inclined surfaces on the inner surface thereof and an opening between said outer and inner surfaces , said opening having a lower flat surface;

(b) a secondary wedge slidably connected on said wedge, said wedge having spaced apart upper and lower downwardly and inwardly inclined surfaces on the outer surface thereof, upper and lower downwardly and outwardly inclined surfaces on the inner surface thereof and an opening between said inner and outer surfaces, said opening having a lower flat surface;

(c) slip means including spaced apart upper and lower downwardly and outwardly inclined surfaces and a recess on the outer surface thereof, said recess having a lower flat surface;

(d) means including pawls and cam plates for slidably connecting said secondary wedges to said wedges and said slips to said secondary wedges so that said outer secondary wedge surfaces slide on said wedge inner surfaces and said outer slip surfaces slide on said inner secondary wedge surfaces;

(e) means preventing said secondary wedges from sliding upwardly on said wedges;

(f) means preventing said slips from sliding downwardly on said secondary wedges; and (g) means for positioning each slip and secondary wedge in mid neutral position on each wedge.

14. The slip assembly of claim 13 wherein the wedge, secondary wedge and slip inclined surfaces are inclined 8½ degrees from vertical.

15. The slip assembly of claim 14 wherein the means slidably connecting secondary wedges to wedges and slips to secondary wedges comprise:

(a) pawls swivelably connected into each side of the wedges and slips, each said pawl having a flat surface;

(b) cam plates connected to each side of each the secondary wedge, said cam plates having inner and outer grooves, said flat surfaces on said wedge pawls slidable in said cam plates outer grooves and said flat surfaces on said slip pawls slidable in said cam plates inner grooves.

16. The slip assembly of claim 15 wherein the cam plate grooves are rectangular in cross section and the upper portion of the outside of the outer groove is inclined upwardly and outwardly 8½ degrees from vertical and the upper portion of the inside of the inner groove is inclined upwardly and inwardly 8½ degrees from the vertical.

17. The slip assembly of claim 13 wherein the slip means comprise a slip insert having an inner surface for gripping pipe anchored in each slip.

18. The slip assembly of claim 13 wherein the means preventing the secondary wedges from sliding upwardly on the wedges comprise:

(a) a downwardly facing shoulder on the inner surface of each wedge; and (b) an upwardly facing shoulder on the outer surface of each second wedge.

19. The slip assembly of claim 13 wherein the means preventing the slips from sliding downwardly on the secondary wedges comprise:

(a) a downwardly facing shoulder on the outer surface of each slip; and (b) an upwardly facing shoulder on the inner surface of each secondary wedge.

20. The slip assembly of claim 13 wherein the means for positioning each slip and secondary wedge in mid neutral position on each wedge comprises:

(a) an arm pivotally connected in each wedge opening, said arm extending through the secondary wedge opening into the slip recess and having a lower flat surface;

(b) a compressed spring mounted around a bolt anchored in a hole in said secondary wedge so that said spring applies a downward force on said arm; and (c) lower flat surfaces in said wedge opening, said secondary wedge opening and said slip recess flat surfaces engageable with said arm lower flat surface.

21. The slip assembly of claim 13 wherein the wedge, secondary wedge and slip inclined surfaces are inclined 5°–10° from vertical.

* * * * *